US009885192B2

(12) United States Patent
Gustason

(10) Patent No.: US 9,885,192 B2
(45) **Date of Patent: *Feb. 6, 2018**

(54) SPA COVER

(71) Applicant: Donald Gustason, Auburn, CA (US)

(72) Inventor: Donald Gustason, Auburn, CA (US)

(73) Assignee: E2E LLC, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/499,070

(22) Filed: Sep. 26, 2014

(65) Prior Publication Data

US 2017/0159308 A1 Jun. 8, 2017

Related U.S. Application Data

(63) Continuation-in-part of application No. 14/242,777, filed on Apr. 1, 2014, which is a continuation of application No. 12/800,984, filed on May 26, 2010, now Pat. No. 8,683,621.

(51) Int. Cl.
*E04H 4/00* (2006.01)
*E04H 4/10* (2006.01)

(52) U.S. Cl.
CPC ..... *E04H 4/108* (2013.01); *E04H 4/103* (2013.01)

(58) Field of Classification Search
CPC ..... E04H 4/084
USPC ..... 4/498–502
See application file for complete search history.

(56) References Cited

U.S. PATENT DOCUMENTS 7,308,722 B2 12/2007 Koren
8,261,378 B2 * 9/2012 Kanetis ..... E04H 4/065 4/498
8,683,621 B1 * 4/2014 Gustason ..... E04H 4/10 4/498
8,893,319 B2 * 11/2014 Gilbert ..... E03C 1/00 4/598

* cited by examiner

*Primary Examiner* — Lori Baker
(74) *Attorney, Agent, or Firm* — David M. Lang; Law Offices of David M. Lang

(57) ABSTRACT

A spa cover comprising: a) a bladder section having a length and a width approximating that of a water spa; b) a plurality of elongated and generally parallel structures affixed to and substantially spanning the width of the bladder section; c) a plurality of flexible rods affixed to the bladder section and under sufficient tension to compress and create an arc over the width of the bladder section; and d) a cover supported by the flexible rods; wherein the rods and the elongated structures are spaced sufficiently to allow the bladder section and the cover to be rolled lengthwise.

20 Claims, 11 Drawing Sheets

SPA COVER

BENEFIT CLAIM

This application claims the benefit of domestic priority under 35 U.S.C. Section 120 as a Continuation in Part of prior U.S. patent application Ser. No. 14/242,777, filed on Apr. 1, 2014, which is a Continuation of prior U.S. patent application Ser. No. 12/800,894, filed on May 26, 2010, and issued as U.S. Pat. No. 8,683,621, the entire contents of which are hereby incorporated by reference as if fully set forth herein.

BACKGROUND OF THE INVENTION

The applicant hereby rescinds any disclaimer of claim scope in the parent application(s) or the prosecution history thereof and advises the USPTO that the claims in this application may be broader than any claim in the parent application.

BACKGROUND OF THE INVENTION

Field of the Invention

The present invention relates generally to covers for swim spas.

Description of Related Art

The increased popularity and installations of swim spas in many thousands of residences throughout the world has allowed thousands of people the ability to take advantage of physical therapy while being supported by the buoyant nature of water in their own homes. For many of these people, this type of exercise is prescribed by their doctors to rehabilitate certain physical injuries, to slow the effects of disabling diseases or just to enhance their physical wellness.

Swim spas are generally large enough in size to allow swimming in place, jogging and other exercises in the buoyancy of warm or hot water as prescribed by a medical professional. The swim spa is heated and filtered in the same way as a larger swimming pool yet only taking up a small space at the residence.

Most swim spas are supplied with covers that are designed to keep the heat in and keep debris out of the water. Such covers are rigid, heavy and cumbersome which require two people, in fit condition, to move them on and off the spa. For those who are disabled, elderly or physically unable to move the covers, they have to arrange with others to take care of the cover removal and replacement so they can use the swim spa for rehabilitation, exercises or just physical relaxation. The cover handling is the main complaint of most swim spa users which is why an alternative is needed which will allow just the user to remove the cover by him or herself, or if unable to do even this, would only need one helper who could easily remove and replace the swim spa cover to help keep the heat in and any debris out.

U.S. Pat. No. 7,308,722, issued to Koren, Dec. 18, 2007, describes a potential solution to the difficulties in removing and putting into place a spa cover. The system includes a pole and a post, with a first support member and a second support member. The first support member is pivotably connected to the pole while the second support member is pivotably connected to the pole and pivotably connected to the post. The system also includes a first cable connected to the spa cover, a second cable connected to the pole, and a drive mechanism connected to the first and second cables. In this manner, the burden of lifting the cover is shifted to a mechanical mechanism.

A secondary problem with hard covers supplied with the spa is the seal between the several sections. A flap with Velcro, which has to be put in place after the spa covers have been put back on the spa, typically covers such seals. While the seal between the spa covers may prevent most debris and rainfall out of the spa water, often this feature is diminished over time as the spa covers begin sagging or warping. Further, the process of affixing the Velcro carefully across the whole seam is a nuisance that most people decide is not worth doing. This leads to a higher cost of operation as heat is lost through the gaps and debris is allowed into the water. The end result is more energy is used to keep the spa water heated, more chemical use to treat the dirtier water, longer filtration time and more frequent filter maintenance Thus, there remains a need for a spa cover that will seal a spa, keeping heat in and debris out, thereby reducing maintenance, but that can easily be removed and reinstalled by one person.

SUMMARY OF THE INVENTION

A system and method are disclosed for a spa and pool covering system that allows increased support and for the cover and insulation for the body of water.

In one embodiment, the invention provides a spa cover comprising: a) a bladder section having a length and a width approximating that of a water spa; b) a plurality of elongated and generally parallel structures affixed to and substantially spanning the width of the bladder section; c) a plurality of flexible rods affixed to the bladder section and under sufficient tension to compress and create an arc over the width of the bladder section; and d) a cover supported by the flexible rods; wherein the rods and the elongated structures are spaced sufficiently to allow the bladder section and the cover to be rolled lengthwise.

In another embodiment, the elongated structures support the bladder section.

In another embodiment, the cover substantially covers the bladder section.

In another embodiment, the bladder section is ovoid.

In another embodiment, the bladder section is generally rectangular.

In another embodiment, the bladder section comprises an elastic material.

In another embodiment, the bladder section is sealed.

In another embodiment, the sealed bladder section is of a buoyancy sufficient to float on the surface of water.

In another embodiment, the elastic material is selected from the group of materials consisting of EDPM rubber membrane and reinforced laminate vinyl fabric.

In another embodiment, the elastic material encapsulates layers of flexible insulation.

In another embodiment, the flexible insulation comprises a resilient foam structure.

In another embodiment, the support structures comprise flexible rod members.

In another embodiment, the flexible rods have a hollow cross section.

In another embodiment, the cover is attached to the respective ends of the flexible tubes.

In another embodiment, the rods are fiberglass.

In another embodiment, the end caps on the tubes for attachment of the rods.

The invention also includes a rollable structure for covering a spa, the structure comprising: a) a bladder at least partially encased in an elastic material, wherein the elastic material contains at least two flexible insulation layers and being sufficiently pliable to compress against a rigid spa surface; b) rigid support members attached to the bladder and arrayed in parallel spanning the spa width; c) a radiant membrane supported on the support members and spaced from the bladder by a distance approximating the width of the support member; and d) a rain fly supported by flexible rods that arc from one end of a each support member to the other end of the same support member and anchored-in the ends of the support members and forming a sealed air chamber between the rain fly and the radiant membrane layer; whereby when the structure is disposed over a spa four separate heat retaining units are formed between the ambient air and the water surface.

In another embodiment, the flexible rods are anchored in holes drilled in the rigid support members.

In another embodiment, the flexible rods each comprise two flexible rods held end to end with a flexible connection.

In another embodiment, the flexible rods each comprise two flexible rods retained end to end with a flexible connector.

These and other features and advantages of this invention are described in, or are apparent from, the following detailed description of various exemplary embodiments of the apparatus and methods according to this invention.

BRIEF DESCRIPTION OF THE DRAWINGS

A more complete understanding of the present invention and the attendant features and advantages thereof may be had by reference to the following detailed description when considered in conjunction with the accompanying drawings wherein.

DETAILED DESCRIPTION OF THE INVENTION

Figure 1:
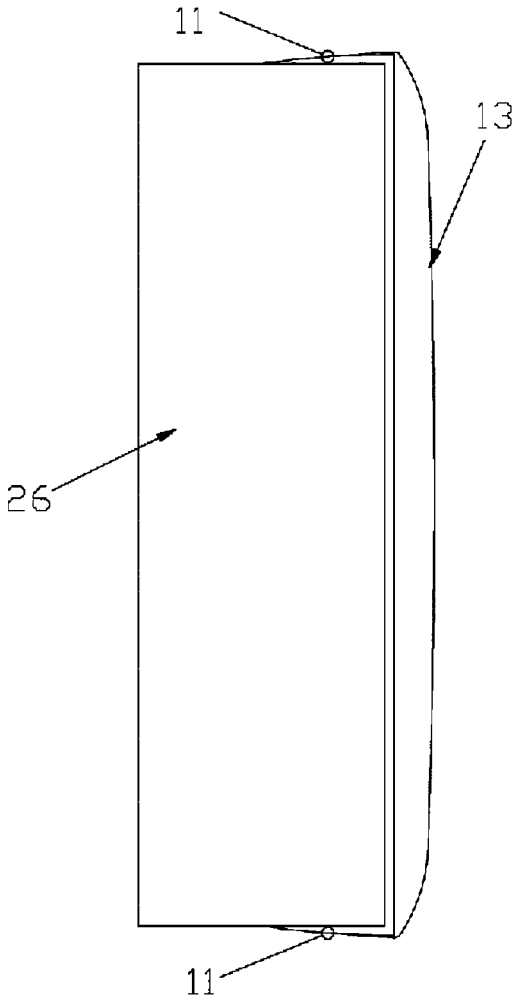
FIG. 1 Side view of a swim spa with cover completely on which shows the domed appearance of the cover when strapped down taut. Side view of a 19 foot long by 7.5 foot wide swim spa rollup cover showing how the cover will be domed when rolled out on the spa and end straps are locked in place stretching the rainfly to a smooth surface from end to end.
Figure 2:
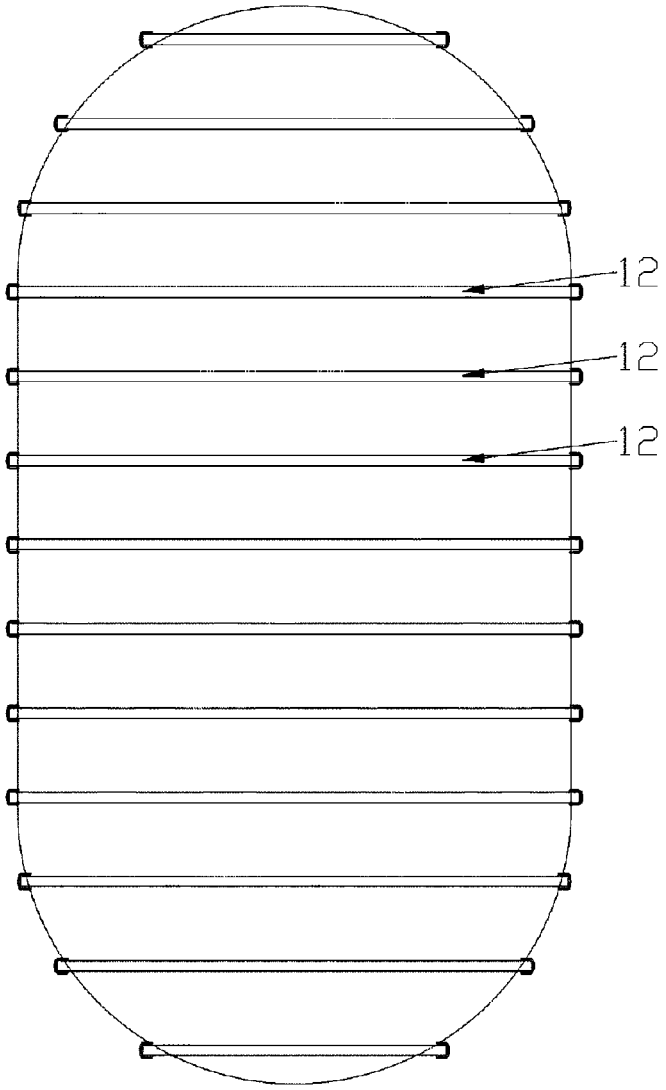
FIG. 2 Plan view of a 19 foot long by 7.5 foot wide swim spa rollup cover without the rainfly which shows the 12" spacing between the square support tubes down the whole length of the spa and perpendicular to its length.
Figure 3:
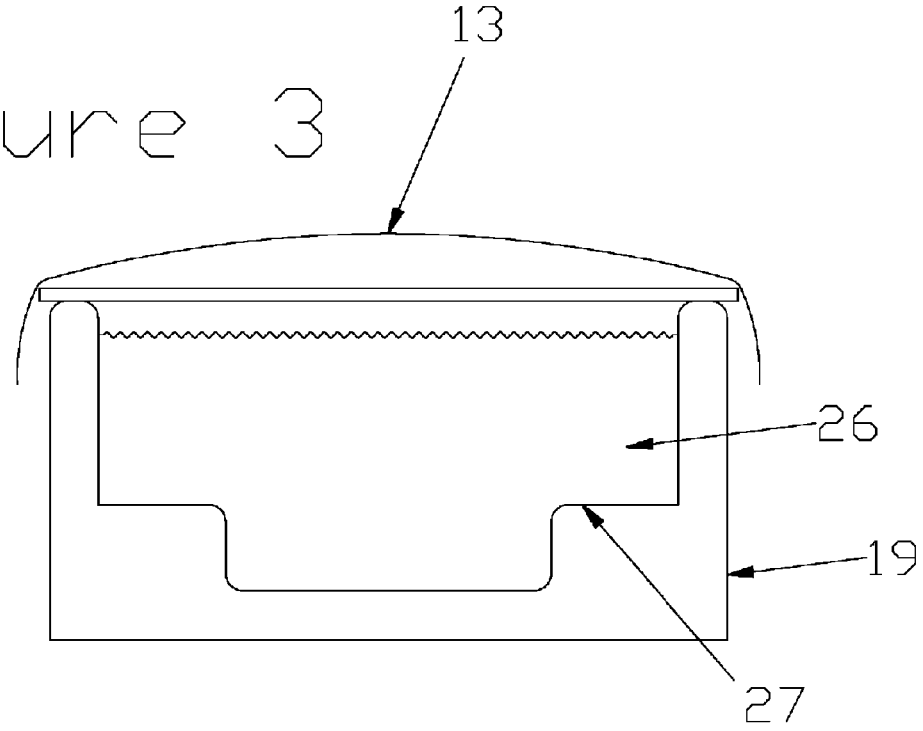
FIG. 3 Section end view of a 19 foot long by 7.5 foot wide swim spa rollup cover showing the arched rainfly assembly from side to side. Please note that FIGS. 1, 2 and 3 show a swim spa with rounded ends. The same construction applies to all other shapes and sizes of spas and swim spas.
Figure 4:
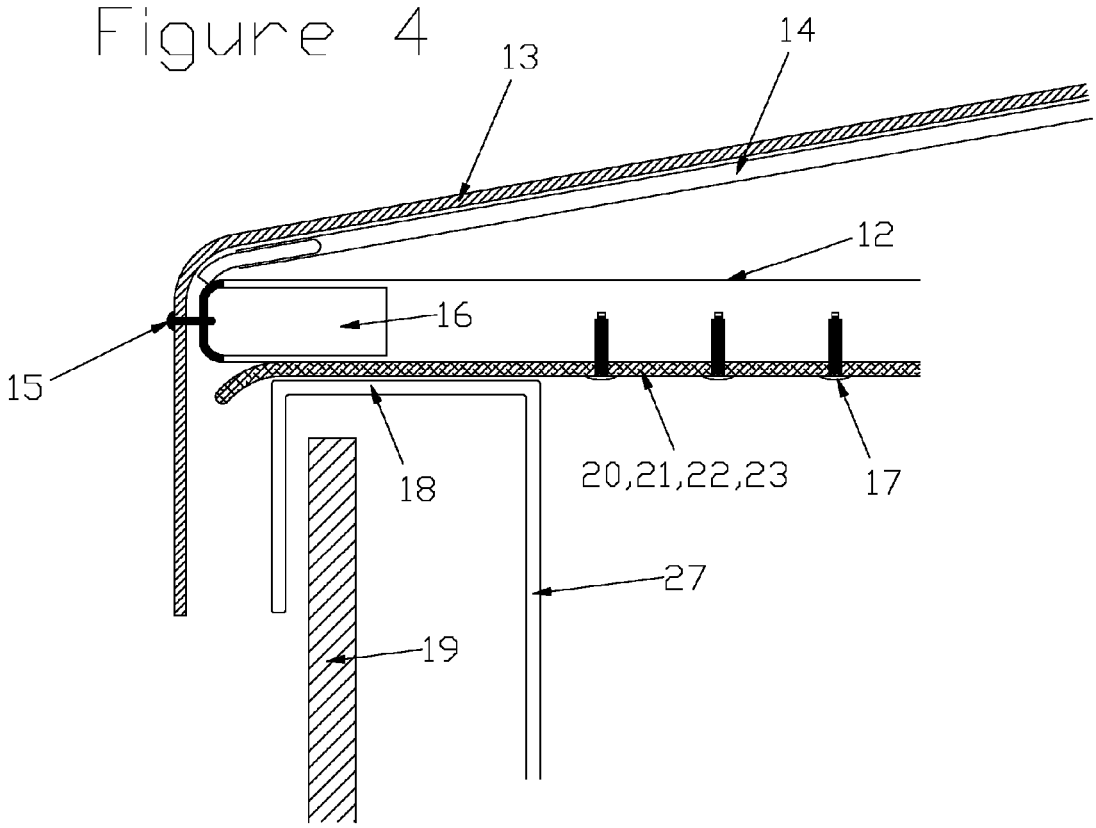
FIG. 4 Detailed cross section view of a complete spa cover as it rests on the spa bartop as viewed from the end of the spa. Starting from the top of the spa shell bartop, the bladder assembly rests directly on top of the bartop and in this area there are not any of the nonmetallic push-in fasteners that may keep a good thermal seal from occurring. The bladder is attached to the bottom of the square support tubes with nonmetallic push-in fasteners so the bladder assembly essentially hangs from the square support tubes over the water surface but not in contact with it. A rainfly support end cap is inserted into the end of the square support tube and fastened in place with a small panhead set screw. The end cap assembly has an attachment built into it so a fiberglass rod can be attached and arched over the width of the spa to the end cap assembly on the other end of the same square support tube. The fiberglass rod supports the water-repellant rainfly which is attached at each of the rainfly support end cap using a stainless steel screw.
Figure 5:
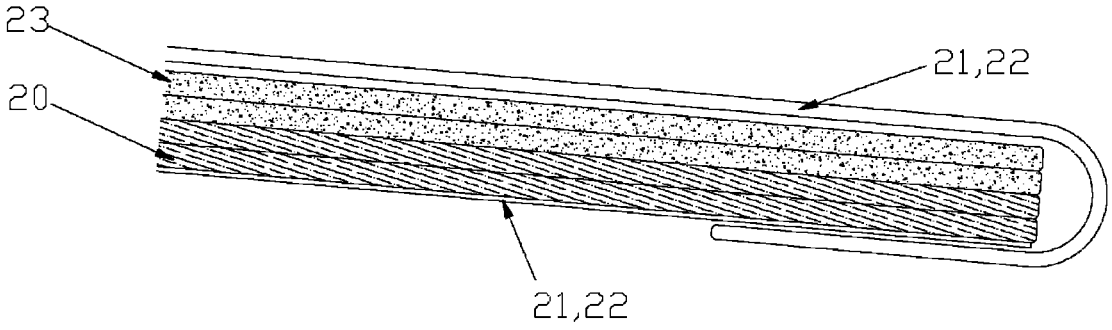
FIG. 5 Cross section view of spa cover materials used in the bladder assembly.
Figure 6:
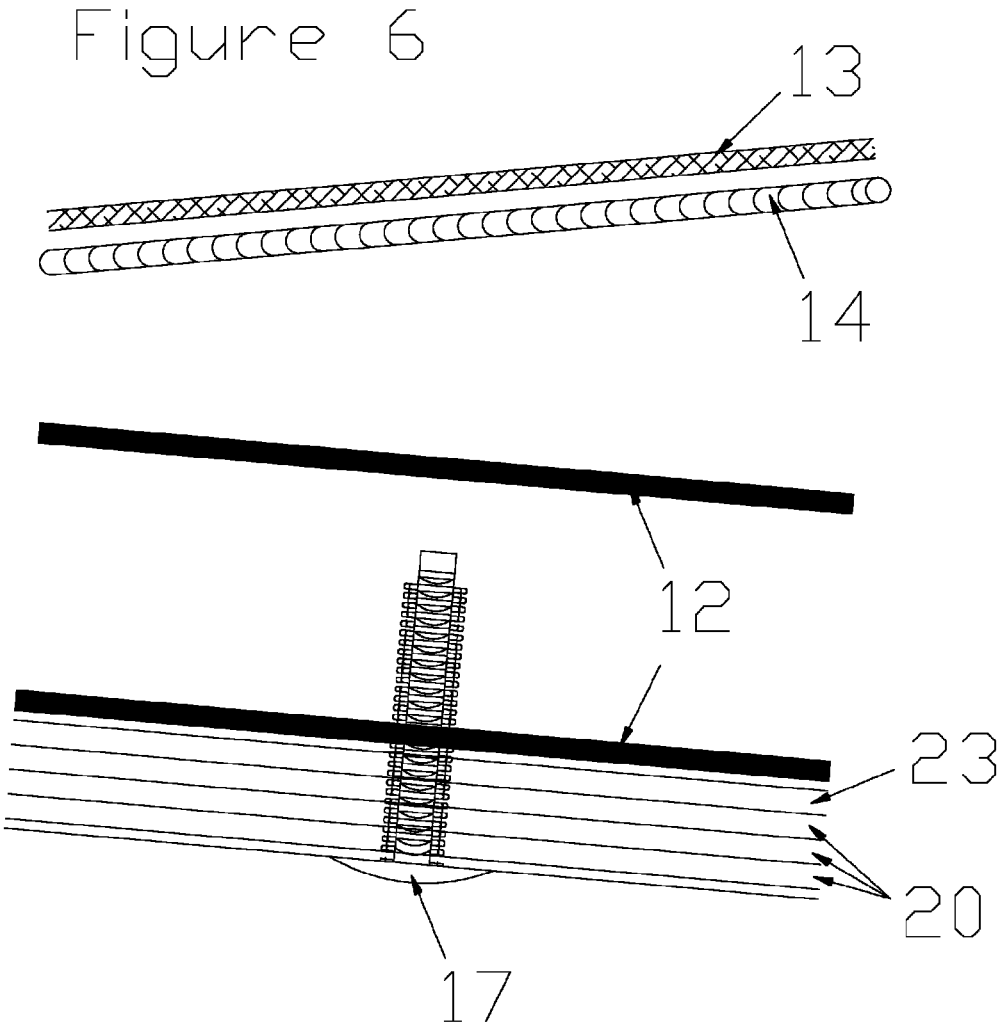
FIG. 6 Cross section view of the bladder assembly attached to square support tubes FIG. 7 Detailed cross section view of complete rollup cover resting on a bartop of spa as viewed from the side of spa.
Figure 7:
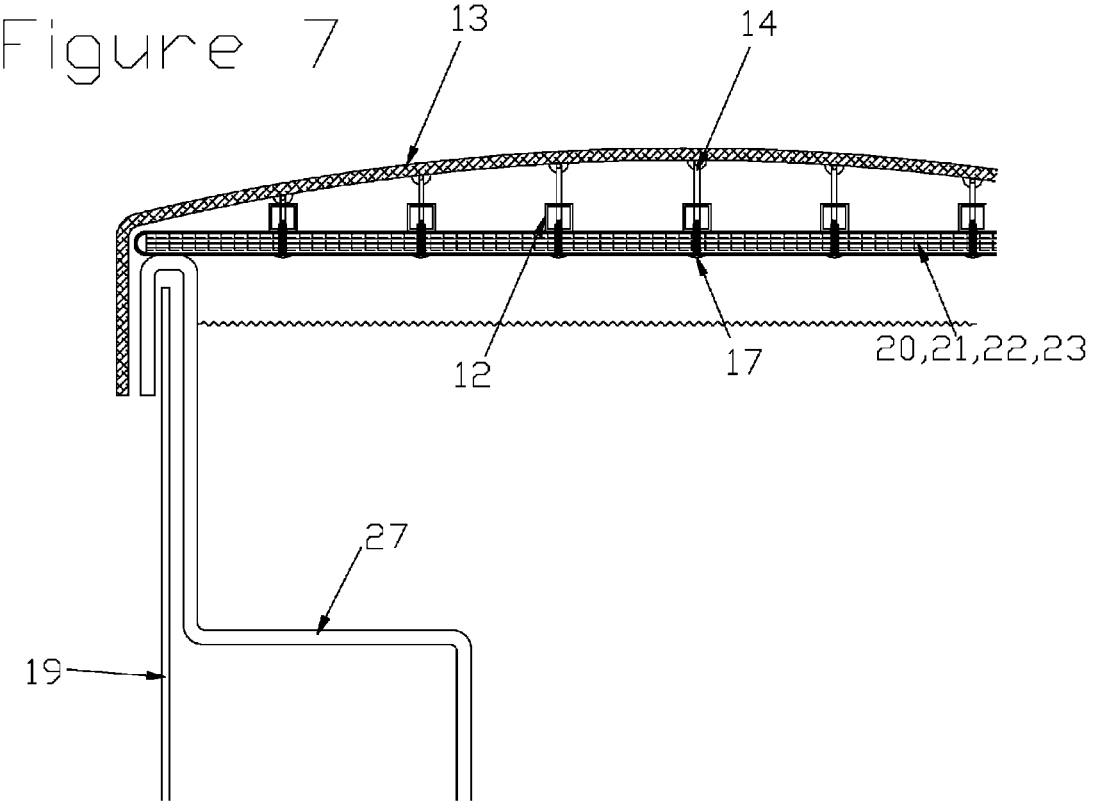
Figure 8:
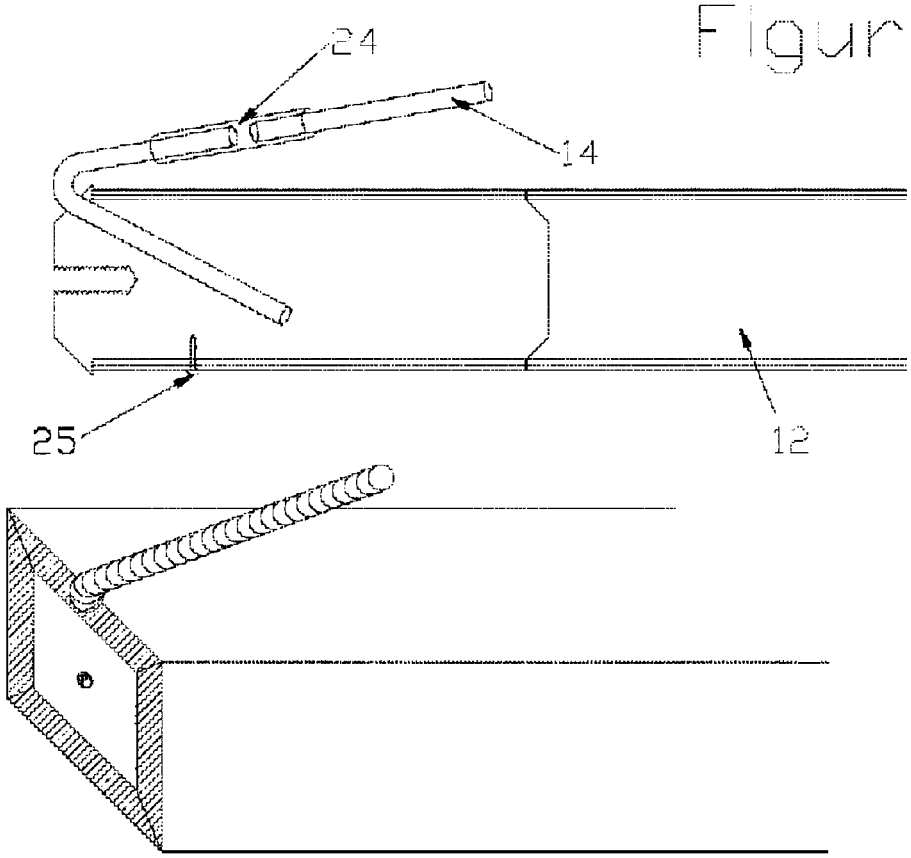
FIG. 8 Detailed drawing of rainfly support application. The assembly is injection molded to fit snuggly in the end of the square support tubes and with finished smooth edges on the side facing the rainfly material to keep friction to a minimum at any contact points. Molded into the insert is a ⅜.sup.th inch thick metal stud or a hollow receiver tube into which the fiberglass rod is inserted and bent between the two attachment points creating an arc. Attachment screws or similar fasteners hold the rainfly, which is stretched over the fiberglass rods which arc from side to side over the bladder and square support tube assembly.
Figure 9:
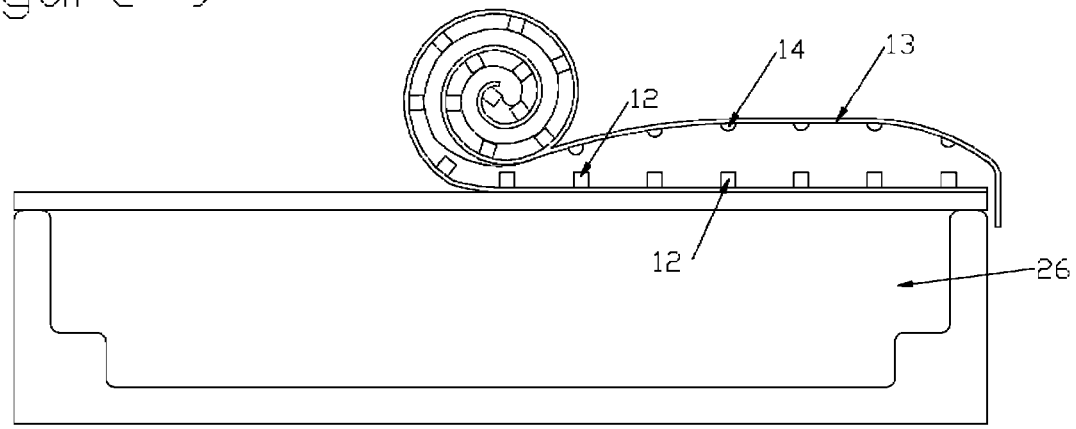
FIG. 9 Section sectional side view of spa with showing cooperation of the elements in folding.
Figure 10:
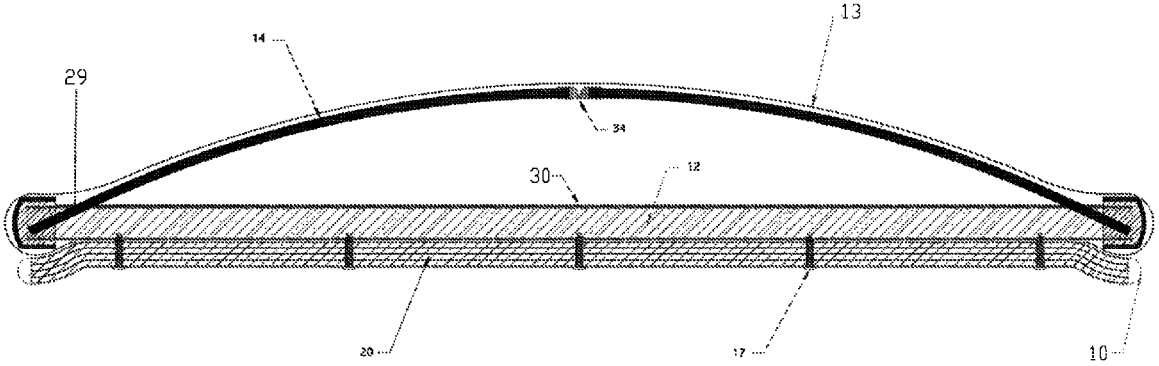
FIG. 10 is a section view taken through the length of a square tube of an alternative spa cover where the flexible rod enters the square tube interiorly to the end cap.
Figure 11:
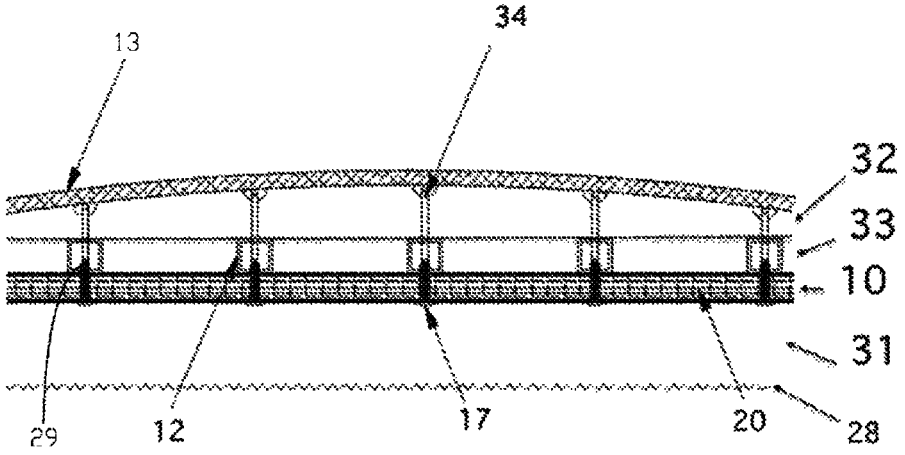
FIG. 11 is a partially cut away sectional view along the length of the alternative spa cover showing the insulation layers inherent in the construction.

A first embodiment of the spa cover assembly is described as seen in FIGS. 1 through 9, and a second embodiment in FIGS. 10 and 11, wherein the noted elements have the following reference numerals in the drawings: 10—base bladder; 11—length adjustable latching strap; 12—square support tubes; 13—rainfly assembly; 14—round fiberglass rods; 15—stainless steel panhead sheet metal screw; 16—rainfly rod support end cap; 17—nylon Christmas tree fastener; 18—spa shell bartop; 19—spa siding skirt; 20—foam sheeting; 21—EDPM rubber sheet; 22—laminated vinyl fabric; 23—aluminized double bubble insulation; 24—metal coupling; 25—stainless steel panhead sheet metal screw; 26—spa; 27—spa shell; 28—spa water level; 29—holes drilled into the square support structure; 30—aluminized radiant barrier; 31—air pocket formed between water and bladder; 32—air pocket formed between fly and radiant membrane over support structure; 33—air layer formed between square tubing beneath the aluminized radiant barrier; 34—flexible rod connectors.

The increased popularity and installations of swim spas in many thousands of residences throughout the world has allowed thousands of people the ability to take advantage of physical therapy while being supported by the buoyant nature of water in their own homes. For many of these people, this type of exercise is prescribed by their doctors to rehabilitate certain physical injuries, to slow the effects of disabling diseases or just to enhance their physical wellness.

Swim spas are generally longer than a Jacuzzi style spa, large enough in size to allow swimming in place, jogging and other exercises in the buoyancy of warm or hot water as prescribed by a medical professional. The swim spa is heated and filtered in the same way as a larger swimming pool yet only taking up a small space at the residence.

The spa cover described herein is a multi-layered rainfly assembly that is flexible enough to be rolled up yet strong enough to shed rain and debris while keeping the heat in the water. This cover can be removed and reinstalled by one person in reasonable physical shape and it will seal the spa, keeping heat in, debris out and maintenance down.

The spa cover comprises a base layer, or "bladder" constructed of layers of pliable insulation encased within a weatherproof vinyl reinforced fabric or a rubber membrane which is attached to rigid square support tubes that run parallel to the short end of the spa. For reasons described more fully bellow, at least two, and preferably 4 layers of ¼ inch foam.

The bladder is encased by a flexible waterproof membrane, any number of options being well known to the art. While the bladder may be entirely encapsulated, it may also be partially encased, though preferably will at a minimum cover the foam layer surface facing the water. Suitable options include EDPM rubber membrane and various reinforced laminate vinyl fabrics, such as an 18 oz vinyl fabric. The layers of flexible insulation are thereby protected from moisture and chemical off-gassing from the spa water. This protective design prevents the oxidation of the critical aluminized double bubble double foil reflective insulation by the corrosive environment of hot spa water.

The encapsulated insulation is fastened to the bottom of a series of parallel support structures, preferably square tubes, with corrosion-free nylon anchors. This rigid support structures allow the soft insulation assembly to span over the water and rest directly on the spa bartop surface sealing the heat in and keeping debris out. In a preferred embodiment the tubes span the approximate 7.5 feet interior width of most swim spas.

An arched fiberglass rod structure is provided that supports a weatherproof rainfly, which is permanently affixed at the edges to the base assembly to shed rain and debris. The entire assembly may be held in place at each end with adjustable straps that stretch the cover from end to end keeping the rainfly taut. Removing the cover to access the spa involves undoing the straps on one end and rolling the cover assembly towards the other end until the desired amount of spa exposure is reached. Covering the spa after use is just the opposite procedure.

The layered design and attachment of the layered materials allows for the soft pliable materials of the bladder to compress slightly and evenly seal all along the bartop of the spa shell. The use of either metal or fiberglass square tubes spanning the spa width serves to suspend the bladder assembly above the water level and helps contribute to a longer life of the cover as it does not directly contact the water. A further advantage is the formation of an insulating sealed air chamber between the spa bladder and the surface.

The square tubes are attached to the flexible bladder in parallel, which allows the cover to be rolled on or off the spa as one would roll up a rug or a sleeping bag. The square tubes contribute superior vertical support capacity the assembly needs as it spans across the spa width as well as providing a flat surface for the attachment of the bladder assembly.

An important and aesthetic part of the assembly is the rainfly cover. It is a weather shield over the top of the whole assembly which when stretched and strapped down on the ends will provide a domed cover which sheds rain, debris, pets, etc.

The use of a permanently attached weatherproof rain fly supported by fiberglass rods that arc from one end of a square tube to the other end of the same tube helps to shed rain and debris. The square tube end caps with built in receivers for the fiberglass rods are anchored in the open ends of some of the square support tubes which in turn allows for the fiberglass rod to be compressed between the special end caps creating an arch which supports the rain fly. The spacing of all rigid components allows everything to roll up together without the need for disassembling or reassembling anything which makes this cover convenient and easy to use which is the desired goal.

The rainfly fabric is precisely tailored to fit on top of ⅜" fiberglass rods which arc from one side of a square support tube to the other end of the same square support tube. The rod attachment to the square support tube is accomplished by the use of a 6 inch long molded plastic insert which is pushed into the end of the hollow square support tube. Since the insert is just slightly smaller than the hollow tube end, it should slide right into the tube ends and be secured in place by short V2 "pan head screws to lock it in place. The solid insert will give plenty of structural strength to support the rainfly rods as well as keep the ends of the hollow tubes from being crushed. The inserts have a ⅜" rod, which is molded into the plastic and exits the outside cap end making an immediate 170 degree bend back over the top of the square support tube. The rainfly rods have hollow tubes on the ends which slip over the end of the insert rod at a 10 degree arc to the opposite end of the same square support tube with its insert also protruding at a 10 degree angle. The rainfly fiberglass rod is compressed in an arc between the two inserts at the ends of the square support tube that then supports the rainfly material, which is stretched over the rods much like a rainfly on a camping tent.

The rainfly fabric has a loop sewn onto it into which the rainfly rods are inserted through before being compressed onto the tube insert end studs. The resulting arc supports the rainfly approximately 8 to 9 inches high in the center when the cover is unrolled but not high enough to impede the rollup flexibility of the cover.

The rainfly structure is then held in place on the ends by straps which when secured, stretches the fabric perpendicular to the support rods, creating a nice, clean, taut, sloped surface which will shed rain and debris. Unlike hard style spa covers, the rollup cover appears soft and flexible which will help to discourage people and pets from trying to walk or sit on it.

The entire rainfly assembly is heavy and initially requires two people to put in place at one end of the spa. Once in place covering the whole spa, a single person can grasp the end of it and start rolling as one would roll up a sleeping bag. The flexibility of the layers of materials allows the cover, once started rolling, to be pushed, like rolling a log, to the end of the spa or anywhere in between. The weight of the layered, flexible material and the square support tubes keeps the cover in place wherever it is rolled to on the spa bartop.

If complete removal of the spa cover from the bartop is desired, it can be rolled onto a cradle assembly at the end of the spa. If the cradle assembly is set up with casters, the whole cover roll can be moved out of the way or out of sight.

The manufacture of the spa cover assembly requires several steps and can be made using two different types of flexible, water and chemical resistant fabrics or membranes. STEP 1a uses an EDPM rubber membrane and STEP 2a uses a laminated vinyl fabric.

STEP 1 a: Assembly of the "Bladder" using EDPM rubber membrane. A sheet of 60 mil Firestone Ecowhite EDPM rubber membrane is cut so that its' dimensions are 15 inches larger on each side than the spa shell surface area it is supposed to cover. It is important to cut the rubber membrane so that any seams in the material run parallel to the end sides of the spa shell. The rubber membrane is placed white side down on the assembly surface and clamped to hold in place.

A sheet of 5/16th inch thick aluminized heat-reflective double-bubble insulation is cut so that its' dimensions are 3 inches larger on each side than the spa shell surface area and placed on the initial layer of 60 mil Ecowhite EDPM rubber. This layer of insulation is then temporarily fastened in place so placement of subsequent layers of other materials will not move it off its' centered placement.

Two sheets of ¼" thick polyethylene closed-cell foam are then cut to the exact same size as the aluminized double-bubble insulation, which is 3 inches wider than the spa shell dimensions on all sides. The two thinner sheets of polyethylene foam are used instead of a single ½ thick foam because the thinner sheets are more flexible, there is not as much rollup compression and expansion as the thicker foam will experience and the finished surfaces of the foam material provides a stronger, longer-lasting cohesiveness of the closed-cell foam. This ½" thickness of foam provides the minimum air space that the manufacturer of the reflective double-bubble insulation recommends for optimum infrared heat refection back down towards the water in the spa. These two sheets of foam are centered on top of the reflective insulation and temporarily fastened in place.

Optionally final sheet of 45 mil or 60 mil EDPM rubber membrane is cut to the exact same size as the layers of insulation and foam. This layer of rubber is centered on top of the layers of insulation. From the plan view, there should be 12 inches of the bottom (or very first) layer of 60 mil Ecowhite EDPM rubber membrane exposed on all sides of the stack of insulation and rubber.

In the embodiment shown in FIGS. 10 and 11, this layer is substituted by an aluminized swim fabric, which forms a further radiant barrier which is affixed as a continuous layer over the square tube support structure. An air layer is formed between adjacent tubes beneath this aluminized barrier, making for addition insulation.

The 12 inches of exposed rubber membrane is folded over the top (or last layer) of rubber and permanently attached using the proper adhesives made specifically for seaming the EDPM rubber membranes together.

Wherever there may be an overlap of rubber material due to the shape of the spa shell or corners, the rubber membrane is cut so there won't be any overlap of materials that would prevent the rubber bladder from making a nice tight seal on the spa bartop.

Preferably a laminated fabric is used instead of the EDPM rubber membrane. Vinyl laminated fabric is used in place of the rubber membrane to encapsulate the same layers of insulation in the same layering sequences and the same sizes as was used in making the rubber membrane "Bladder." The laminated vinyl fabric has to be heat welded, glued or sewn together in order to make sheets large enough to create the "Bladder" encasement. It is important that any welded, glued or sewn seams be parallel to the end sides of the spa shell. The end result is that there will be a "bladder" assembly which has the same materials within it and ends up measuring three inches larger on all sides than the spa shell it is being made for.

Preferably, the bladder assembly forms a complete overlap of the outside perimeter edge of the spa, more preferably by 3 inches on the entire outside perimeter of the spa shell.

STEP 2: Attaching the rigid square support tubes to the bladder. On an assembly table, 1.5"×1.5"×96" square tubes are secured onto a rack which holds them 12 inches on center for the entire length of the spa shell, although for most spa applications, a 16 inch center spacing may be used. On curved or rounded spa shell ends, the square tubes may be place as close as 6" apart to accommodate the clean look of a tight fitting and attachment points for the rainfly assembly around the perimeter of the curved areas of the spa shell. These tubes which are located in the curved areas will be cut so that they extend the same distance beyond the edge of the bladder as anywhere else on the cover assembly. The tubes on the very ends are either solid or reinforced because these are the most handled by use and will have the rainfly assembly attached with screws. For larger spa widths, above 10 feet or so, 2" by 2" tubes are preferred.

The "Bladder" assembly is then positioned on top of the square tubes that have been inserted into the rack. The "Bladder" assembly is placed upside-down on the square tubes so that the side of the bladder that will face the water is now facing up and away from the square tubes.

At each of the square tube locations, a hole-drilling template is positioned directly above the square tubes on which the Bladder now lays. From the center of the Bladder, in intervals of 6 inches, a hole is drilled through the Bladder and into the square support tube. The drill bits are properly sized for whatever fastener type and size is used for maximum holding strength according to the fastener manufacturing specifications. The holes are equally spaced until the holes come within 8 inches of the edge of the Bladder. Fasteners are not installed within the 8 inch wide area of the perimeter because they would compromise the nice seal which the spa cover needs in order to meet the energy saving design of a nice tight seal provided by the spa cover assembly. The only place where fasteners are installed within the 8 inch perimeter zone would be on the very ends of the cover where square tubes are attached for hold down strap anchoring and rainfly attachment.

Once all the holes are drilled, the hole-drilling template is removed and a nylon push-in locking Christmas tree type fastener is pushed into the holes and into the square support tube which locks the bladder assembly to the tubes. A light tap with a hammer pushes the head of the fastener into the Bladder creating a dimple in the bladder so that none of the fasteners will be able to contact any surface the cover is placed upon. This same process continues until all square tubes have fasteners every 6 inches along its length to a location not within 8 inches to the edge of the bladder assembly.

Now that the bladder assembly is completely attached to the square support tubes the whole assembly needs to be removed from the square tube placement rack and placed square tube side up as it would sit upon the spa shell surfaces.

STEP 3: Attaching the faintly assembly to the spa cover assembly. The ends of the square support tubes can now be filled or capped with one of two types of square tube end caps. The caps need to be as smooth as possible to minimize friction points that may over time cause premature wear of the rainfly as it is attached to the square tubes on the capped ends. Regular square tube end caps which just fill the square tube ends and allow for the attachment of the rainfly are inserted into the open ends of the square tubes and fastened to the square tube with a screw so that the end cap cannot fall off the cover assembly. The screw attachment is made on the vertical side of the square tubes to keep the screw heads from ever contacting the bladder assembly or the rainfly assembly. These regular end caps are installed on the square tubes starting on the ends and on every other square tube, which should put them every two feet apart.

Rainfly support end caps, which are designed to support fiberglass rods, which are compressed into an arc between the ends of the square support tubes, are inserted and fastened in place into the open ends of the square support tubes. The rainfly support end caps are solid plastic blocks that are sized to fit exactly within the square support tubes to a depth of approximately six inches which will give the square support tubes excellent resistance to being crushed and give extra torque strength since these are supporting the rainfly. A 318th inch thick zinc plated steel rod approximately six inches long is bent to an acute angle of 20 degrees so that two inches of it are on one side of the tight bend and the remaining four inches are on the other side. The four inch side of the rod can be deformed so that when molded into the plastic block that it will be anchored in place so that the two inch side of the rod exits the plastic block and points at a 20 degree angle back over the top of the filler block. The rainfly support end cap is then inserted into the ends of the square support tubes so that the metal rod is pointing directly over the top of the square tube and directly towards the other end of the same support tube. As with the regular end caps, the rainfly support end caps are screwed to the square support tubes on the vertical sides of the square support tubes.

Once all the open ends of the square support tubes are filled in, the fiberglass rods are compressed into place between the receiver for the fiberglass rod on one side of the spa cover assembly and the other side, directly above and parallel to the square support tube. The arc height must be approximately 9 inches so that when the cover assembly is rolled up, the arched fiberglass rod fits nicely between the square support tubes which will not hinder the spa process. Once all the rods are put in place, looking down the ends of the cover assembly, all of the fiberglass rods need to arc at the same height except the two rainfly rods at the ends of the cover assembly which may only peak out seven inches high which will give the spa cover a nice sleek appearance once the rainfly is attached.

The rainfly is a water-resistant reinforced vinyl fabric made to perfectly fit on top of the arched fiberglass rods and attach along the spa perimeter which gives the spa cover its' sleek appearance and weather protection. The rainfly is designed to fit snuggly over the fiberglass rods and to be attached to the square tube end caps which will keep the rainfly fabric taut. In order to keep the rainfly support rods in the proper location, a series of loops which are sewn, welded or heat seamed are added to the underside of the rainfly at the highest point so that the fiberglass rods can be inserted into the loop directly above the square support tubes. Once this has been done for each of the fiberglass rods, each rod can then be inserted into the rainfly support receivers on the rainfly support square tube on either end. The rainfly can then be centered over the arched rods and attached to the square tubes.

FIG. 10 depicts and alternative design, where instead of specialized caps, the flexible rods are inserted into holes. Further, to increase the flexibility of the rods in rolling, flexible rod connectors can be included so that each rod comprises two connected shorter rods spanning the rain fly.

The rainfly should now be attached to the square tube s using #8×¼" Phillips Truss head stainless steel screws. Starting at the middle of the cover, the rainfly fabric will be centered from side to side on top of the fiberglass support rods and fastened onto one of the center square tube s with a ⅜th" stainless steel washer to help spread out the pressure of the screw on a larger area of fabric. Now on the opposite end of the same center square tube the fabric will be pulled taut and fastened to the support with a #8×¾" SS Phillips truss screw, ⅜" SS washer and two ½" nylon washers. The order the hardware is applied is one nylon washer between the rainfly and rainfly support end cap, then another nylon washer so that the fabric is sandwiched between the nylon washers. The screws with a washer will be driven into predrilled holes in the s far enough to bottom out the screw heads onto the washers, which in turn compress the fabric onto the assembly. This procedure is duplicated from the center down to the ends. A key step in this process is to ensure that as the rainfly is stretched over the fiberglass rods and attached to the s that the fiberglass rods are straight up and down as viewed from the side positions at every square tube which supports the rainfly assembly. The rainfly attachment to the rollup spa cover on the very end square tubes on a square ended spa is done using the same hardware used on the attachment of the rainfly on the ends of the square tube except the screws will penetrate every 6 inches starting from the center into the long side of the square tube facing away from the spa. On round-ended spas, the rainfly attachment is at the ends of the square tubes as they extend just beyond the bladder assembly every six inches along the perimeter of the circular spa shape.

Now that the rainfly is attached to the framework at the edges of the spa cover, the adjustable straps which will keep the rainfly taut from end to end needs to be attached to the square tubes at each end of the cover assembly. There should be a main strap at the center of each end which is attached to the end square tube with two #8×¾' SS Phillips truss screws. The strap should be sufficient in length to allow for locking length adjustment hardware to be installed somewhere between the bottom of the spa cover and the spa siding or decking around the spa. When these two main straps are attached, the spa cover rainfly should be pulled taut from one end to the other and latched down. Finally at two locations on either side of the main straps and at desired intervals down the sides, locking hold-down straps are added for child safety and extra wind restraints. The appearance of the spa cover assembly, when completely unrolled and strapped down should be a taut slightly domed structure covering the entire spa. With a 6 inch valence attached to the rainfly and hanging around the entire perimeter, the spa shell is protected from the weather and the appearance is clean.

FIG. 10 depicts an embodiment using the aluminized radiant barrier attached to and spanning the tops of the support structures. In this embodiment, four insulating levels are formed over the water level: first, the air pocket formed between the water surface and the lower surface of the bladder; second, the insulating foam layers of the bladder itself; third, the spaces formed between the support squares and the aluminized radiant barrier; and finally a fourth level between the rain fly and the aluminized barrier.

Each layer thus forms a separate contained or sealed region for retaining heat against transfer from the water up through the cover structure to the ambient air. In a test, identical spas having identical water temperatures were covered with a standard foam insulation spa cover (hinged panels of encased 5 inch foam) and the four-level heat retention spa cover depicted in FIGS. 10 and 11. The spas were allowed to sit 24 hours and then heated to the same standard spa temperature of 100 degrees F.

The spas were then maintained at the set temperature for 48 hours. The four separate levels of sealed insulation were found to save between 10 to 15% of electricity costs in heating the spa and maintaining the temperature at 100 degrees F.

The assembly of the spa cover is now complete and ready for easy roll-on and roll-off use for many years to come.

While the present invention is described with reference to the illustrations for specific applications, it should be understood that the invention is not limited to those applications. Those skilled in the art with access to invention described herein will recognize additional modifications, applications, and embodiments within the scope thereof and additional fields in which the invention would be of significant utility

What is claimed is:

1. A spa cover comprising:

a) a bladder section having a length and a width approximating that of a water spa;

b) a plurality of elongated and generally parallel structures affixed to and substantially spanning the width of the bladder section;

c) a plurality of flexible rods affixed to the bladder section and under sufficient tension to compress and create an arc over the width of the bladder section; and d) a cover supported by the flexible rods;

wherein the rods and the elongated structures are spaced sufficiently to allow the bladder section and the cover to be rolled lengthwise.

2. The cover of claim 1, wherein the elongated structures support the bladder section.

3. The cover of claim 1, wherein the cover substantially covers the bladder section.

4. The cover of claim 1, wherein the bladder section is ovoid.

5. The cover of claim 1, wherein the bladder section is generally rectangular.

6. The cover of claim 1, wherein the bladder section comprises an elastic material.

7. The cover of claim 6, wherein the bladder section is sealed.

8. The cover of claim 7, wherein the sealed bladder section is of a buoyancy sufficient to float on the surface of water.

9. The cover of claim 6, wherein the elastic material is selected from the group of materials consisting of EDPM rubber membrane and reinforced laminate vinyl fabric.

10. The cover of claim 6, wherein the elastic material encapsulates layers of flexible insulation.

11. The cover of claim 10, wherein the flexible insulation comprises a resilient foam structure.

12. The cover of claim 1, wherein the support structures comprise flexible rod members.

13. The cover of claim 1, wherein the flexible rods have a hollow cross section.

14. The cover of claim 1, wherein the cover is attached to the respective ends of the flexible tubes.

15. The cover of claim 1, wherein the rods are fiberglass.

16. The cover of claim 1, further comprising end caps on the tubes for attachment of the rods.

17. A rollable structure for covering a spa, the structure comprising: a) a bladder at least partially encased in an elastic material, wherein the elastic material contains at least two flexible insulation layers and being sufficiently pliable to compress against a rigid spa surface; b) rigid support members attached to the bladder and arrayed in parallel spanning the spa width; c) a radiant membrane supported on the support members and spaced from the bladder by a distance approximating the width of the support member; and d) a rain fly supported by flexible rods that arc from one end of a each support member to the other end of the same support member and anchored-in the ends of the support members and forming a sealed air chamber between the rain fly and the radiant membrane layer; whereby when the structure is disposed over a spa four separate heat retaining units are formed between the ambient air and the water surface.

18. The structure of claim 17 wherein the flexible rods are anchored in holes drilled in the rigid support members.

19. The structure of claim 17 wherein the flexible rods each comprise two flexible rods held end to end with a flexible connection.

20. The structure of claim 17 wherein the flexible rods each comprise two flexible rods retained end to end with a flexible connector.

* * * * *